United States Patent [19]

Laska

[11] 4,202,502

[45] May 13, 1980

[54] CUTTING TOOL ASSEMBLY FOR MEAT MINCER

[75] Inventor: Friedrich Laska, Linz, Austria

[73] Assignee: Imperial Chemical Industries Limited, London, England

[21] Appl. No.: 947,408

[22] Filed: Oct. 2, 1978

[30] Foreign Application Priority Data

Oct. 6, 1977 [AT] Austria ..... 7119/77

[51] Int. Cl.[2] ..... B02C 18/36

[52] U.S. Cl. ..... 241/82.5; 17/1 G

[58] Field of Search ..... 99/516, 518; 17/1 G, 17/46; 241/82.1–82.7, 89.4

[56] References Cited

U.S. PATENT DOCUMENTS

| | | | |
|---|---|---|---|
| 3,847,360 | 11/1974 | Seydelmann | 241/82.5 |
| 4,093,128 | 6/1978 | Barnes | 241/82.5 |

FOREIGN PATENT DOCUMENTS

| | | | |
|---|---|---|---|
| 336426 | 9/1974 | Austria | 241/82.5 |

*Primary Examiner*—Mark Rosenbaum

*Attorney, Agent, or Firm*—Cushman, Darby & Cushman

[57] ABSTRACT

A meat grinder comprises a perforated disc member and a coaxial knife member with a plurality of cutting blades. The members have cooperating end faces and one member is mounted on a shaft for rotation relative to the other. Each cutting blade end face defines a plurality of waste discharge grooves and each groove has an inlet point at the shearing edge of the blade and extending from the inlet point towards the entrance to a waste discharge tube. The inlet points of the grooves defined circular paths coaxial with the disc and knife members and each groove extends in a direction deviating from the circular paths.

2 Claims, 4 Drawing Figures

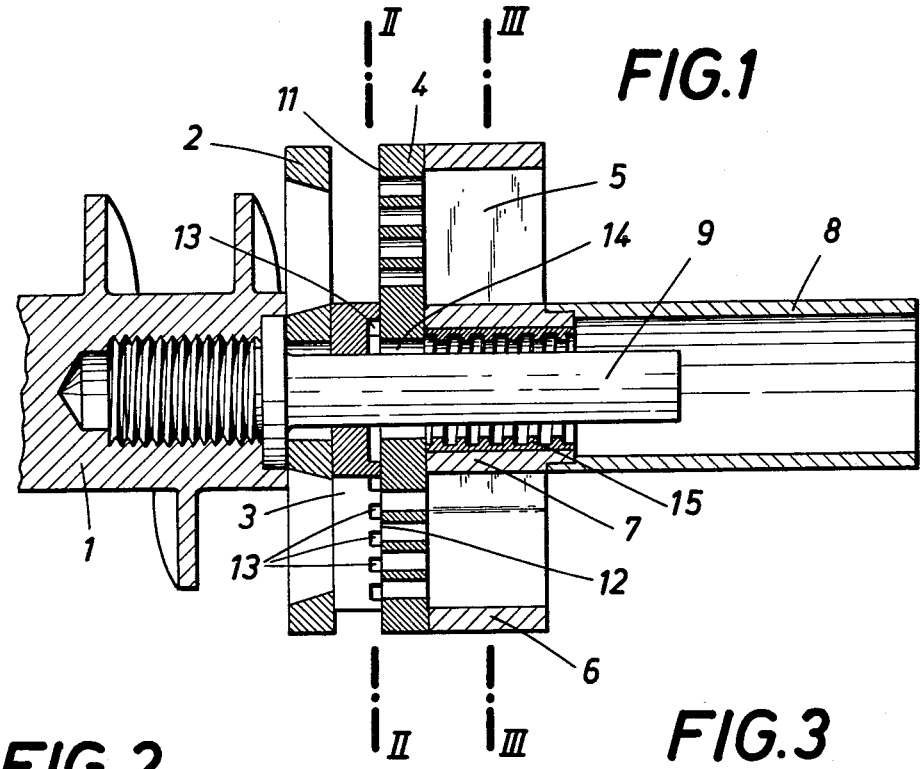
FIG.1
FIG.2
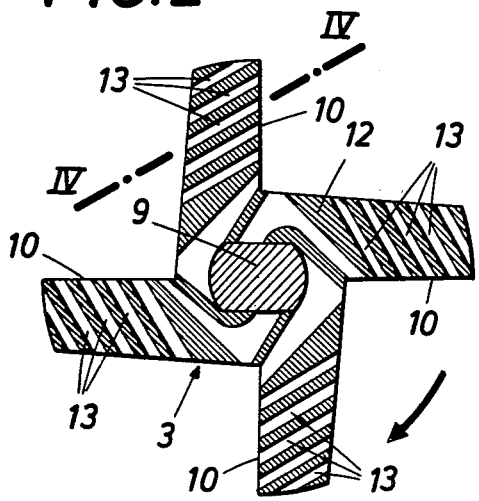
FIG.3
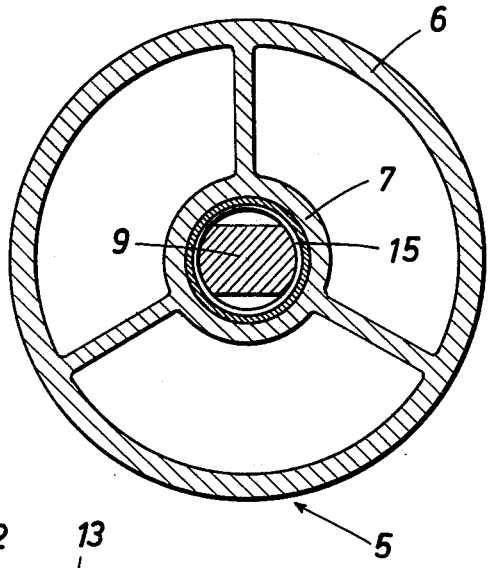
FIG.4
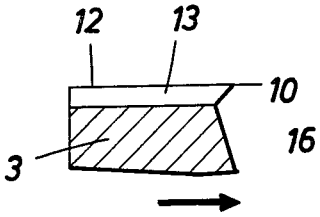

CUTTING TOOL ASSEMBLY FOR MEAT MINCER

This invention relates to a cutting tool assembly for use in meat grinders, comprising at least one perforated disc and a cutting knife, which has a plurality of blades with shearing edges for cooperating with said disc. The perforated disc and cutting knife are coaxially mounted and one of them is rotatable relative to the other. Grooves leading to a separate waste discharge device are provided between the cooperating end faces of the perforated disc and cutting knife and serve to divert hard or tough portions of the material being minced.

Most of such cutting tool assemblies comprise a plurality of perforated discs, which are axially aligned and have increasingly smaller perforations and winged knives which are disposed between adjacent ones of said perforated discs. Either the cutting knife or the perforated discs are rotated by means Patent a central shaft. To avoid a clogging of the assembly and other disturbances in operation by coarse portions of the material to be minced, such as bone material or cartilage, which cannot enter the fine perforations of the perforated discs and for this reason cannot be engaged by the shearing edges, channels are provided between each cutting blade and each adjacent perforated disc and owing to the relative rotation of the cutting blade and perforated disc divert these portions to a separate waste discharge device, by which said portions are discharged independently from material which has been minced. Austrian Pat. No. 336,426 teaches to provide these channels in the end face of the perforated disc, which in imperforate areas is formed with suitable recesses which extend more or less radially from the periphery of the disc to the center bore thereof. The diverted material is then discharged through said center bore. To enable a forwarding of said diverted material, the hub of the cutting knife extends through the center bore of the perforated disc and into an adjoining tubular portion and the outside surface of the hub and the inside surface of the tubular portion are formed with crossing helical grooves for axially forwarding the diverted material. Because the perforated disc has imperforate portions formed with the recesses, the perforations of the perforated disc are not closely spaced everywhere and the open area for the passage of the valuable material to be minced is decreased. Besides, the number of channels is restricted and the provision of these channels in the perforated disc, the specially designed hub of the knife, and the forwarding grooves of the waste discharge device involve considerable manufacturing costs and a high purchasing price.

For this reason it is an object of the invention to eliminate these disadvantages and to provide a cutting tool assembly which is of the kind described first hereinbefore and can be manufactured in a relatively simple manner and at low cost, permits the use of perforated discs having perforations which are closely spaced everywhere and ensures a particularly good rejection of hard and tough portions of the material to be minced.

This object is accomplished according to the invention in that the channels consist of grooves which are formed in the end faces of the cutting blades and extend from respective shearing edges and deviate toward the entrance to the waste discharge device from the circular path described by the inlet point of the groove at the respective shearing edge. Such grooves may be straight or curved and can be formed without any difficulty and in cooperation with a conventional perforated disc, which has perforations that are closely spaced everywhere and for this reason has a maximum open area, will ensure the desired high rejecting efficiency. The direction in which waste material will be diverted will depend on the arrangement of the grooves and can be freely selected. For this reason a waste discharge devcie may be provided not only at the center but also at the periphery or between the center and periphery.

Because grooves in the cutting blades can be formed in a much larger number than channels in the perforated disc, the rejection of the hard and tough portions of the material to be minced is greatly improved and the mincing rate is substantially increased as the edges of the grooves constitute additional shearing edges.

As the cutting knife according to the invention ensures an excellent rejection, a plain tube would be sufficient as a waste discharge device. On the other hand, if the cutting knife or perforated disc is non-rotatably fitted on a conventional flattened portion of a drive shaft and a central waste discharge device is provided, which has an entrance defined by the central bore of the perforated disc or of the cutting knife discharge capacity of the waste discharge device can be increased if, in accordance with a preferred embodiment of the invention at least part of the grooves in the end faces of the cutting blades extend directly into the center bore of the perforated disc or cutting blade and the waste discharge device associated with the grooves consists of an internally screw-threaded, circularly cylindrical sleeve which surrounds the drive shaft and axially adjoins the center bore of the perforated disc or of the knife, which center bore constitutes the entrance to said sleeve. In such an arrangement, material entering between the flats of the shaft and the inside surface of the sleeve will be continuously moved outwardly along the internal screw threads as a result of the rotation of the shaft. That effective conveyor requires only a simple sleeve formed with corresponding screw threads.

An embodiment of the invention is shown by way of example on the accompanying drawing, in which FIG. 1 is an axial sectional view showing a cutting tool assembly embodying the invention, FIGS. 2 and 3 are transverse sectional views taken on lines II—II and III—III, respectively, in FIG. 1, and FIG. 4 is an enlarged sectional view taken on line IV—IV in FIG. 2.

The cutting tool assembly shown on the drawing comprises a pre-cutter 2 disposed next to a feed screw 1 of a meat grinder and succeeded by a winged cutting knife 3, a perforated disc 4, and a discharge device 5, in that order. The discharge device 5 consists essentially of two concentric sleeves. The outer one of these sleeves is designated 6 and defines an annular passage with inner sleeve 7 serving to discharge the more valuable material which has been cut and has passed through the perforated disc 4. The inner sleeve 7 defines a central passage serving to discharge the rejected hard and tough portions of the material to be cut. The inner sleeve 7 is continued by an extension tube 8 in communication with the central passage, by which the rejected parts are separated from the remaining material to be cut. The winged knife 3 is non-rotatably mounted on a flattened shaft 9 which is screwed in the feed screw. The blades of winged cutting knife 3 have shearing edges 10 which wipe over the surface 11 of the perforated disc 4. End faces 12 of the blades of winged cutting knife 3 which cooperates with the surface 11 of the perforated disc 4 define grooves 13 which extend from respective shearing edges 10 and serve to divert those portions of the material to be cut which are so coarse or tough that they cannot be forced through the perforations of the perforated disc 4. The grooves are designed to cause hard and tough portions to slide in said grooves toward the center bore 14 of the perforated disc 4. That center bore 14 constitutes an entrance to a waste discharge device which consists of the inner sleeve 7 and the extension tube 8 and serves to discharge said tough and hard portions. The inner sleeve 7 consists of a circular cylinder surrounding the flattened shaft 9. To promote the forwarding of the portions passing through said entrance, the inner sleeve 7 is formed with internal screw threads 15 so that a rotation of the shaft 9 will cause the material to be forced axially along said screw threads. To improve the cutting conditions for the shearing edges of the cutting knife 3 and to improve the rejection of the hard and tough portions by the grooves 13, those side faces 16 of the cutting blades which define the shearing edges 10 are forwardly inclined relative to said shearing edges 10 in the direction of rotation so that there is a wedge-shaped gap between the surface 11 of the perforated disc and the side walls 16 and the material is forced toward the shearing edges or into the grooves 13 by the surfaces defining said gap.

The cutting tool assembly according to the invention is distinguished mainly by having a simple design, low manufacturing costs and excellent functional characteristics.

What is claimed is:

1. In a meat grinder, which comprises a perforated disc member having an end face, a knife member coaxial with the disc member and having a plurality of cutting blades each having an end face disposed closely adjacent the end face of the perforated disc member, each cutting blade having a shearing edge arranged to cooperate with the end face of the perforated disc member, a drive means for rotating one of the members relative to the other member, and a waste discharge device having an entrance, the improvement of each cutting blade end face defining a plurality of waste discharge grooves, each waste discharge groove having an inlet point at the shearing edge of the blade and extending from the inlet point towards the entrance of the waste discharge device, the inlet points of the grooves defining circular paths coaxial with the disc and knife members, and each groove extending in a direction deviating from the circular paths.

2. In the meat grinder of claim 1, the drive means comprising a rotatable shaft extending axially through the disc and knife members, the one member being mounted on the rotatable shaft non-rotatably relative thereto whereby it is rotated thereby, the other member having a bore defining a clearance around the shaft, the clearance constituting the entrance to the waste discharge device, and the waste discharge device comprises a sleeve concentrically surrounding the shaft, the sleeve axially adjoining the clearance and being in communication therewith, and the sleeve having internal screw threads.

* * * * *

UNITED STATES PATENT AND TRADEMARK OFFICE

CERTIFICATE OF CORRECTION

PATENT NO. : 4,202,502

DATED : May 13, 1980

INVENTOR(S) : Friedrich Laska

It is certified that error appears in the above—identified patent and that said Letters Patent is hereby corrected as shown below:

On the Title Page, Item (73) Assignee should be deleted in its entirety.

On the Title Page, Attorney, Agent or Firm should read

-- Kurt Kelman --.

Signed and Sealed this

*Fifth* Day of *August 1980*

[SEAL]

*Attest:*

SIDNEY A. DIAMOND

*Attesting Officer*

*Commissioner of Patents and Trademarl*